US007984843B2

(12) United States Patent
Cooper et al.

(10) Patent No.: US 7,984,843 B2
(45) **Date of Patent: *Jul. 26, 2011**

(54) CARTON WITH REINFORCED HANDLE

(75) Inventors: Leonard M. Cooper, Powder Springs, GA (US); Andrea Coltri De Paula, Marietta, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/561,379

(22) Filed: Sep. 17, 2009

(65) Prior Publication Data

US 2010/0025457 A1 Feb. 4, 2010

Related U.S. Application Data

(63) Continuation-in-part of application No. 11/532,293, filed on Sep. 15, 2006, application No. 12/561,379.

(60) Provisional application No. 60/719,040, filed on Sep. 21, 2005, provisional application No. 61/192,302, filed on Sep. 17, 2008.

(51) Int. Cl.
*B65D 5/46* (2006.01)
*B31B 1/26* (2006.01)

(52) U.S. Cl. ..... 229/117.16; 493/162

(58) Field of Classification Search ..... 229/117.16, 229/117.08, 117.09, 117.12, 117.15, 117.17; 493/70, 80, 88

See application file for complete search history.

(56) References Cited

U.S. PATENT DOCUMENTS

| | | | |
|---|---|---|---|
| 2,196,502 | A | 4/1940 | Kells |
| 2,308,050 | A | 1/1943 | Burr |
| 2,386,905 | A | 10/1945 | Meitzen |
| 2,648,484 | A | 8/1953 | Belsinger |
| 2,900,123 | A | 8/1959 | Drnec et al. |
| 3,173,596 | A | 3/1965 | Aust et al. |
| 3,756,499 | A | 9/1973 | Giebel et al. |
| 4,005,815 | A | 2/1977 | Nerenberg et al. |
| 4,538,759 | A | 9/1985 | Dutcher |
| 4,621,766 | A | 11/1986 | McClure |

(Continued)

FOREIGN PATENT DOCUMENTS

EP 0870688 A1 10/1998

(Continued)

OTHER PUBLICATIONS

International Search Report PCT/US2009/057247, Sep. 17, 2009, Graphic Packaging International, Inc.

(Continued)

*Primary Examiner* — Justin M Larson
*Assistant Examiner* — Christopher Demeree
(74) *Attorney, Agent, or Firm* — Womble Carlyle Sandridge & Rice, PLLC

(57) ABSTRACT

A carton for containing a plurality of articles. The carton comprises a top panel, a bottom panel, a first side panel, a second side panel, a top end flap foldably connected to the top panel, and a side end flap foldably connected to one of the first side panel and the second side panel. The carton includes a handle in the closed end of the carton for grasping and carrying the carton. The side end flap comprises a main panel for closing the closed end of the carton and an extension panel foldably attached to the main panel an the top end flap.

23 Claims, 7 Drawing Sheets

U.S. PATENT DOCUMENTS

| | | | | |
|---|---|---|---|---|
| 5,072,876 | A * | 12/1991 | Wilson | 229/103.2 |
| 5,119,985 | A | 6/1992 | Dawson et al. | |
| 5,350,109 | A | 9/1994 | Brown et al. | |
| 5,588,585 | A | 12/1996 | McClure | |
| 6,112,977 | A | 9/2000 | Sutherland et al. | |
| 6,170,741 | B1 | 1/2001 | Skolik et al. | |
| 6,250,542 | B1 | 6/2001 | Negelen | |
| 6,595,411 | B2 | 7/2003 | McClure | |
| 6,631,803 | B2 * | 10/2003 | Rhodes et al. | 206/427 |
| 6,766,940 | B2 | 7/2004 | Negelen | |
| 6,848,573 | B2 | 2/2005 | Gould et al. | |
| 6,968,992 | B2 | 11/2005 | Schuster | |
| 7,757,933 | B2 | 7/2010 | Dunn | |
| 7,775,418 | B2 | 8/2010 | Walling | |
| 7,780,067 | B2 | 8/2010 | Holley, Jr. | |
| 7,832,622 | B2 | 11/2010 | Spivey, Sr. | |
| 2005/0087592 | A1 | 4/2005 | Schuster | |
| 2005/0189405 | A1 | 9/2005 | Gomes et al. | |
| 2005/0263574 | A1 | 12/2005 | Schuster | |
| 2006/0081691 | A1 | 4/2006 | Smalley | |
| 2006/0278689 | A1 | 12/2006 | Boshinski et al. | |
| 2007/0063003 | A1 | 3/2007 | Spivey et al. | |
| 2007/0108261 | A1 | 5/2007 | Schuster | |
| 2007/0131748 | A1 | 6/2007 | Brand | |
| 2010/0025457 | A1 | 2/2010 | Cooper et al. | |

FOREIGN PATENT DOCUMENTS

| | | |
|---|---|---|
| WO | WO9928198 | 10/1999 |

OTHER PUBLICATIONS

Written Opinion PCT/US/2009/057247, Sep. 17, 2009, Graphic Packaging International, Inc.

Preliminary Amendment dated Mar. 12, 2008 for related U.S. Appl. No. 11/532,293, filed Sep. 15, 2006.

Office Action mailed Jun. 10, 2009, for related U.S. Appl. No. 11/532,293, filed Sep. 15, 2006.

Amendment A dated Sep. 1, 2009, for related U.S. Appl. No. 11/532,293, filed Sep. 15, 2006.

Office Action mailed Dec. 9, 2009, for related U.S. Appl. No. 11/532,293, filed Sep. 15, 2006.

Office Action mailed Feb. 7, 2011, for related U.S. Appl. No. 11/532,293.

* cited by examiner

CARTON WITH REINFORCED HANDLE

CROSS-REFERENCE TO RELATED APPLICATIONS

This application claims the benefit of U.S. Provisional Application No. 61/192,302, filed Sep. 17, 2008. This application is a continuation-in-part application of U.S. patent application Ser. No. 11/532,293, filed Sep. 15, 2006, which claims the benefit of U.S. Provisional Application No. 60/719,040, filed Sep. 21, 2005.

INCORPORATION BY REFERENCE

The entire disclosures of U.S. Patent Application Nos. 61/192,302, filed Sep. 17, 2008; Ser. No. 11/532,293, filed Sep. 15, 2006, and 60/719,040, filed Sep. 21, 2005 are incorporated herein in their entirety by this reference.

BACKGROUND OF THE DISCLOSURE

The present disclosure generally relates to cartons for holding beverage containers or other types of articles. More specifically, the present disclosure relates to cartons having a reinforced handle

SUMMARY OF THE DISCLOSURE

In general, one aspect of the disclosure is directed to a carton for containing a plurality of articles. The carton comprises a top panel, a bottom panel, a first side panel, a second side panel, a top end flap foldably connected to the top panel, and a side end flap foldably connected to one of the first side panel and the second side panel. The carton includes a handle in the closed end of the carton for grasping and carrying the carton. The side end flap comprises a main panel for closing the closed end of the carton and an extension panel foldably attached to the main panel an the top end flap.

In another aspect, the disclosure is generally directed to a carton for containing a plurality of articles. The carton comprises a plurality of panels that extends at least partially around an interior of the carton. The plurality of panels comprise a top panel, a bottom panel, a first side panel, and a second side panel. At least two end flaps are respectively foldably attached to respective panels of the plurality of panels. The end flaps are overlapped with respect to one another and thereby at least partially form a closed end of the carton. The at least two end flaps comprise at least one side end flap and at least one top end flap. A handle is in the closed end of the carton for grasping and carrying the carton. The at least one side end flap of the at least two end flaps comprises a main panel for closing the closed end of the carton and an extension panel foldably connected to the main panel and the at least one top end flap. The extension panel is positioned above the handle to reinforce the carton when the at least one top end flap is closed.

In another aspect, the disclosure is generally directed to a blank for forming a carton. The blank comprises a plurality of panels comprising a top panel, a bottom panel, a first side panel, and a second side panel. At least two end flaps respectively foldably attached to respective panels of the plurality of panels at a first marginal end of the blank. The at least two end flaps comprises at least one side end flap and at least one top end flap. The blank has features in the at least two end flaps that are for cooperating to at least partially define a handle in a carton erected from the blank. The at least one side end flap of the at least two end flaps comprises a main panel for closing an end of the carton erected from the blank and an extension panel foldably attached to the main panel and the at least one top end flap. The extension panel is for being positioned above the handle when the blank is erected into the carton.

In another aspect, the disclosure is generally directed to a method of assembling a carton. The method comprises obtaining a carton comprising a plurality of panels, comprising a top panel, a bottom panel, a first side panel, and a second side panel. The carton comprises at least one side end flap foldably attached to at least one of the first and second side panels at a first end of the carton, and at least one top end flap foldably attached to the top panel at the first end. The at least one side end flap comprises a main panel for at least partially forming a closed end of the carton and an extension panel foldably attached to the main panel and the top end flap. The method further comprises folding the at least one side end flap to at least partially close the first end of the carton, folding the top end flap downward to contact the extension panel and fold the extension panel downward to overlap the main panel, and securing the top panel to at least partially close the carton.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass or plastic beverage bottles) as disposed within the carton embodiments. In this specification, the terms "lower," "bottom," "upper" and "top" indicate orientations determined in relation to fully erected and upright cartons.

Figure 1:
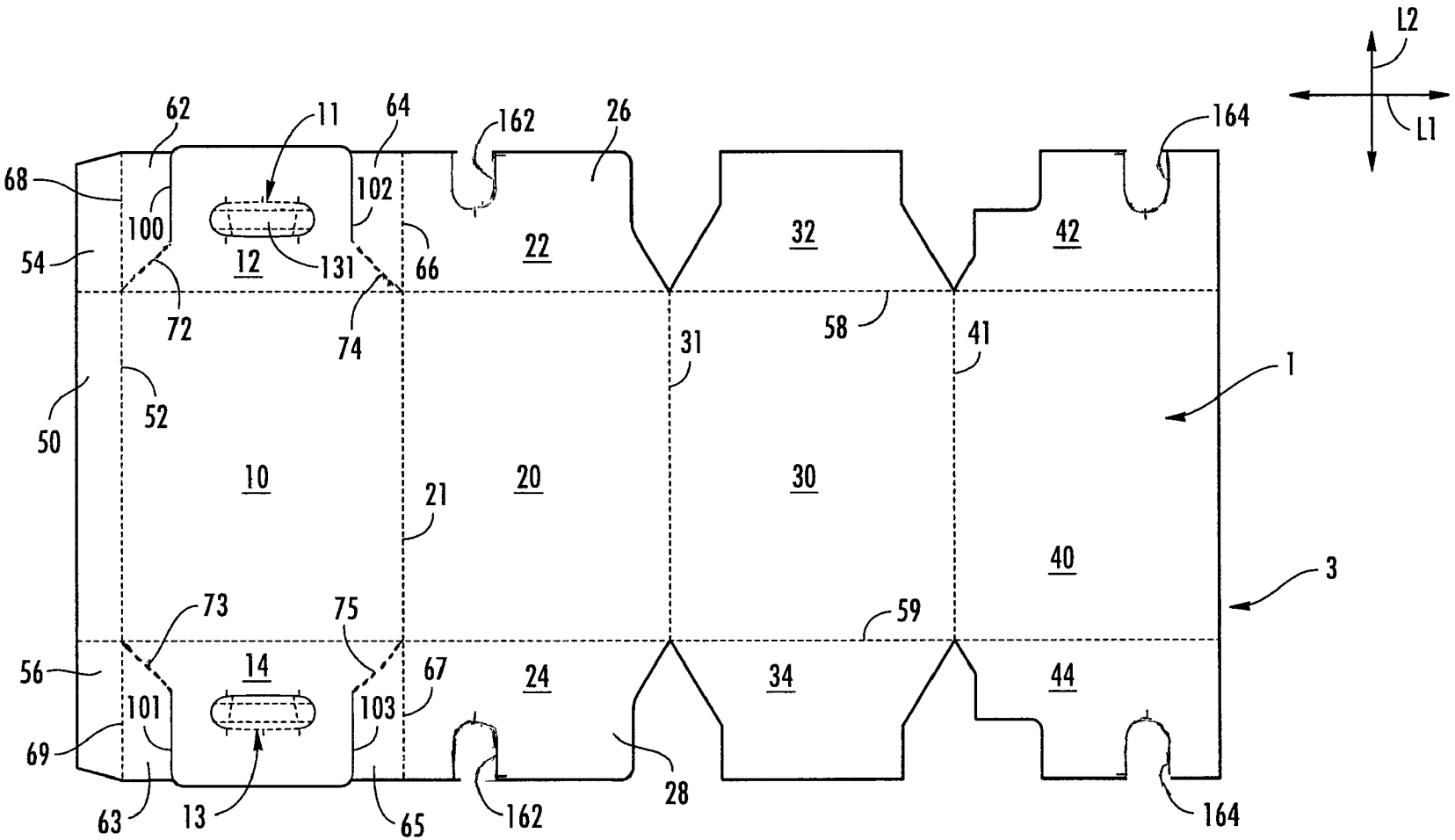
FIGS. 1-7 are respective views of a blank and/or a carton according to one embodiment of the disclosure.

FIG. 1 is a plan view of the exterior side 1 of a blank, generally indicated at 3, used to form a carton 5 (FIGS. 3-7) according to the exemplary embodiment of the disclosure. The carton 5 can be used to house a plurality of articles such as containers (not shown). In the illustrated embodiment, the carton 5 is sized to house 20 containers in a 4×5 arrangement, but it is understood that the carton 5 may be sized and shaped to hold containers of a different or same quantity in more than one layer and/or in different row/column arrangements (e.g., 1×6, 3×6, 2×6×2, 3×4×2, 2×9, 2×6, 3×4, etc.). In the illustrated embodiment, the carton 5 includes handles, generally indicated at 11 and 13 for grasping and carrying the carton. As will be discussed below in more detail, handles 11 and 13 are formed from various features in the blank 3.

The blank 3 has a longitudinal axis L1 and a lateral axis L2. In the illustrated embodiment, the blank 3 comprises a top panel 10 foldably connected to a first side panel 20 at a first lateral fold line 21, a bottom panel 30 foldably connected to the first side panel 20 at a second lateral fold line 31, and a second side panel 40 foldably connected to the bottom panel 30 at a third lateral fold line 41. In the illustrated embodiment, the blank 3 includes an adhesive flap 50 foldably connected to the top panel 10 at a fourth lateral fold line 52.

The top panel 10 is foldably connected to a first top end flap 12 and a second top end flap 14. The first side panel 20 is foldably connected to a first side end flap 22 and a second side end flap 24. The bottom panel 30 is foldably connected to a first bottom end flap 32 and a second bottom end flap 34. The second side panel 40 is foldably connected to a first side end flap 42 and a second side end flap 44. The adhesive flap 50 has a first side adhesive portion 54 and a second side adhesive portion 56. In the illustrated embodiment, the first and second side end flaps 22, 24 each comprise a main panel 26, 28 and an extension panel 64, 65 foldably connected to the main panel 26, 28 along a respective lateral fold line 66, 67. In the illustrated embodiment, the lateral fold lines 66, 67 are generally co-linear with, and extend from the lateral fold line 21. The extension panels 64, 65 are foldably connected to the top end flaps 12, 14 along a respective oblique fold line 74, 75.

As further illustrated, the side adhesive portions 54, 56 are foldably connected to a respective extension panel 62, 63 at a respective lateral fold line 68, 69. In the illustrated embodiment, the lateral fold lines 68, 69 are generally co-linear with, and extend from the lateral fold line 52. The extension panels 62, 63 are foldably connected to the top end flaps 12, 14 along a respective oblique fold line 72, 73.

In the illustrated embodiment, each extension panel 62, 63, 64, 65 is detachably connected to a respective top end flap 12, 14 at a respective breachable line of disruption (e.g., tear line) 100-103. Alternatively, the tear lines 100-103 could be cut lines or other lines of weakening without departing from this disclosure. The tear lines or cut lines 100-103 extend laterally from the end of a respective oblique fold line 72-75 to a respective edge of one of the top end flaps 12, 14.

When the carton 5 is erected, the top and bottom end flaps 12 and 32 and side end flaps 22 and 42 close a first end 51 (FIG. 3) of the carton, and the top and bottom end flaps 14 and 34 and side end flaps 24 and 44 close a second end 53 of the carton in a similar manner as the first end. In accordance with an alternative embodiment of the present disclosure, different flap arrangements can be used for closing the first end 51 and/or the second end 53 of the carton 5.

The top and bottom end flaps 12, 32, the side end flaps 22, 42, and the side adhesive flap 54 extend along a first marginal area of the blank 3, and are foldably connected at a first longitudinal fold line 58 that extends along the length of the blank 3. The top and bottom end flaps 14, 34, side end flaps 24, 44, and the side adhesive flap 56 extend along a second marginal area of the blank 3, and are foldably connected at a second longitudinal fold line 59 that extends along the length of the blank 3. The longitudinal fold lines 58, 59 may be, for example, substantially straight, or offset at one or more locations to account for blank thickness or for other factors.

In one embodiment, the oblique fold lines 74, 75 respectively obliquely extend from an intersection with one of the lateral fold lines 66, 67, one of the longitudinal fold lines 58, 59, and one of the lateral fold lines 21, 52. The oblique fold lines 72, 73 respectively obliquely extend from an intersection with one of the lateral fold lines 68, 69, one of the longitudinal fold lines 58, 59, and one of the lateral fold lines 21, 52. The oblique fold lines 72-75 could be otherwise shaped, arranged, and/or configured without departing from the disclosure.

Figure 2:
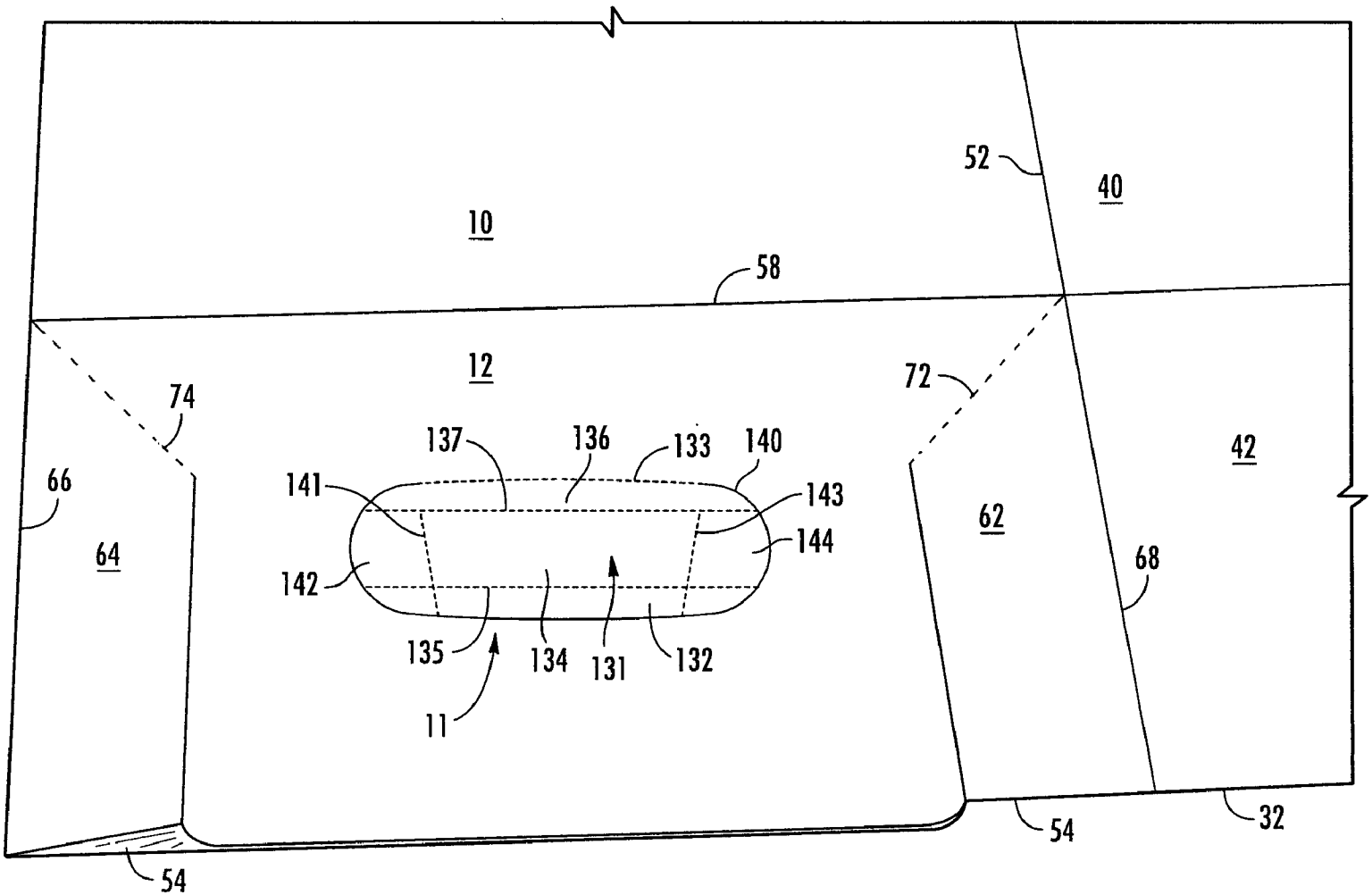

In the illustrated embodiment, the features that form the two handles 11, 13 are substantially similar, but only one of the handles 11 is described in detail herein. As shown in FIG. 2, the handle 11 includes an elongate handle flap 131 formed in the top end flap 12 and foldably attached to the top panel at fold line 133. In the illustrated embodiment, the handle flap 131 includes two longitudinal fold lines 135, 137 that extend across the length of the handle panel. The fold line 133 extends between respective ends of a tear line 140 that at least partially defines the handle flap 131 in the top panel end flap 12. The fold lines 135, 137 respectively extend between the tear line 140 of the elongated handle flap 131. As shown in FIG. 2, the fold lines 133, 135, 137 divide the handle panel into portions or strips 132, 134, 136 that are respectively foldably connected. The handle flap 131 includes two curved fold lines 141, 143 extending generally laterally between the fold line 137 and a portion of the tear line 141 opposite the fold line. The curved fold lines 141, 143 define two end portions 142, 144 of the handle flap 131 and a central portion 146 of the handle panel. The two end portion 142, 144 of the handle flap 131 are foldably connected to the central portion 146 to facilitate forming the handle 11 when the handle panel is pushed inward. The curved fold lines 141, 143 could be otherwise shaped, arranged, and/or omitted without departing from the disclosure. Tear line 140 extends beyond fold line 133 and into elongated panel 132 terminating at fold line 135.

Figure 3:
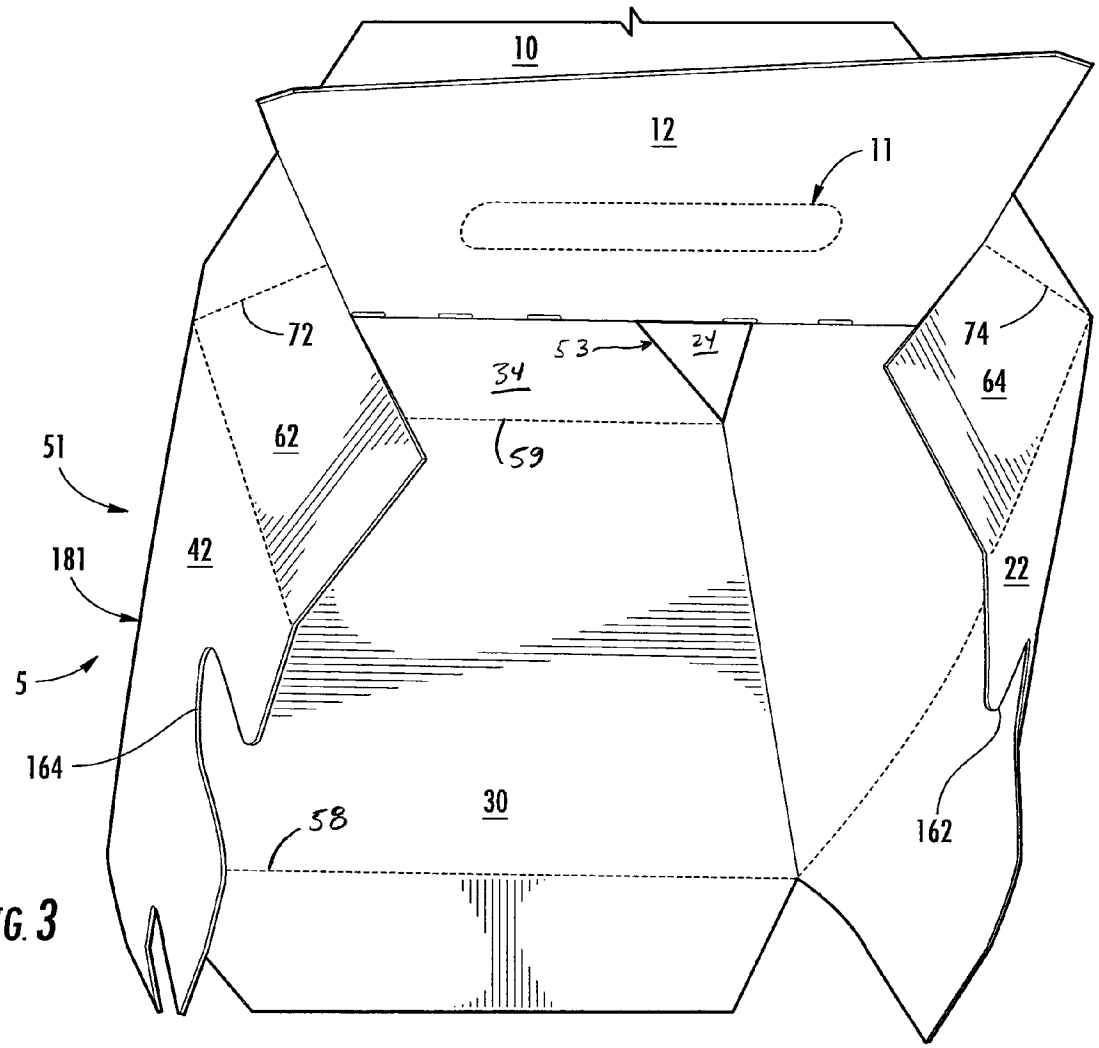
Figure 4:
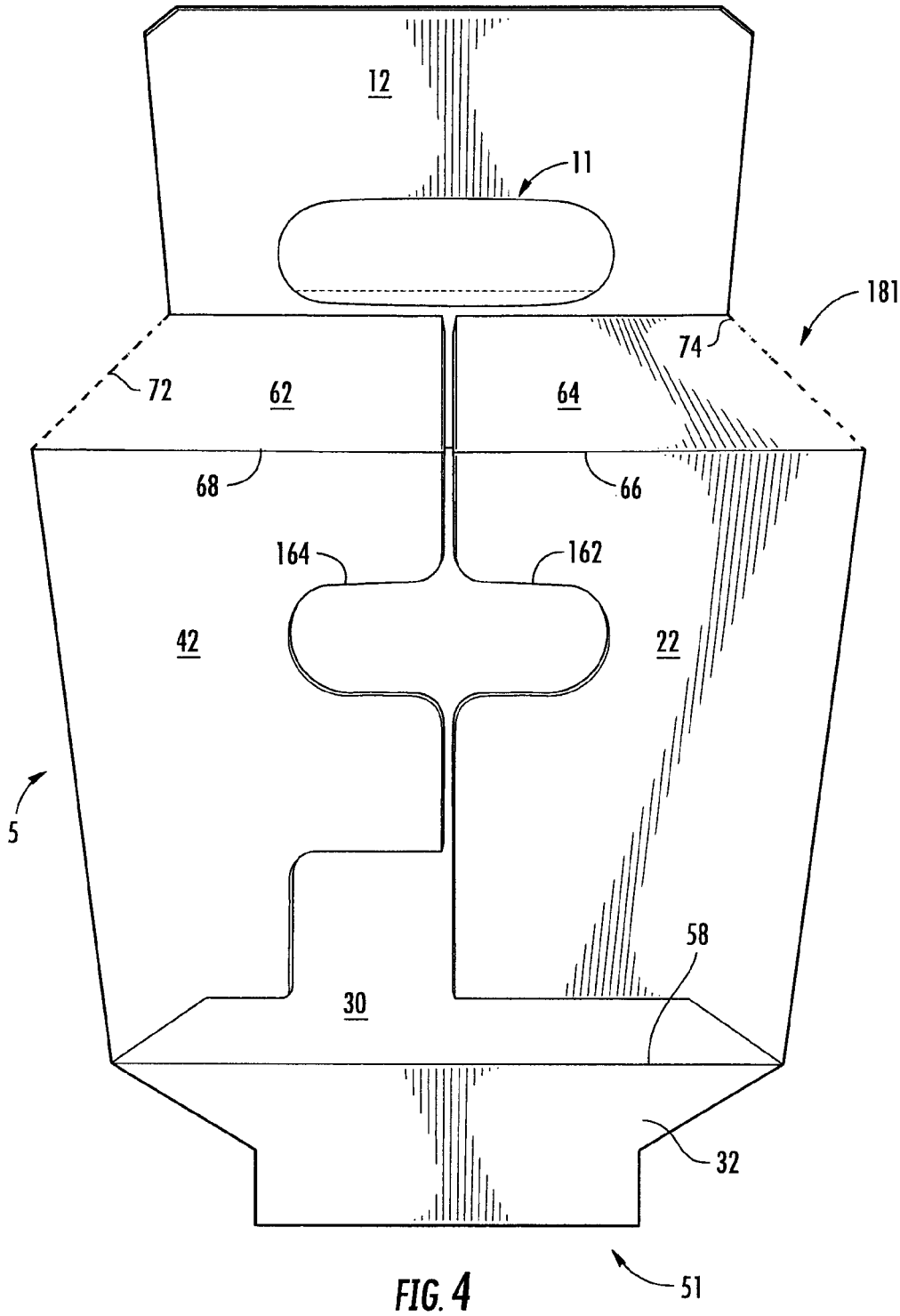

As shown in FIGS. 3 and 4, the features of the handles 11, 13 include respective curved cutouts 162, 164 in the side end flaps 22, 42 to allow the elongate handle panels 131, 133 to fold inwardly when the handle is activated to form handle openings 170 (FIG. 7) in the carton 5. In the illustrated embodiment, the extension panels 62, 64 are discontiguous with the features (e.g., cutout 162, 164) in a respective side end flap 22, 24 that form handle 11. As shown in FIG. 1, the side end flaps 22, 24, 42, 44 could comprise flaps foldably connected to a respective side end flap instead of cutouts 162, 164. The flaps 162, 164 are positioned for overlapping a respective handle flap 131 upon activation of a respective handle 11, 13. In the illustrated embodiment, features that form the handle 13 in the bottom end flap 14 are identical to those of handle 11 in the top end flap 12. The handle 13 could comprise other features or the handle could be omitted without departing form the disclosure.

The elongate handle flap 131 is shaped and positioned in the blank 3 so that the handle 11 is activated by pressing on the handle panel and folding the handle panel inward into the curved cutouts 162, 164 to form the handle openings 170 in the carton 5. The opening 170 is shaped for insertion of a users fingers during grasping of the carton 5. In the illustrated embodiment, when the carton 5 is closed and the handle 11 activated for grasping of the carton (FIG. 7), the handle flap 131 is folded inward along fold line 133 to be in opposing face-to-face relation with the interior surface of a respective upper portion of the side panel end flaps 22, 42. One or both of the handles 11, 13 may be otherwise shaped and located in the carton 5 without departing from the scope of this disclosure. The handle 13 may be similarly activated for grasping of the carton 5.

In accordance with the exemplary embodiment, the blank 3 can be erected into the carton 5 by folding along the fold lines 21, 31, 41, and 52 and adhering the adhesive flap 50, to the second side panel 40, to form a sleeve 181 (FIG. 3). The side adhesive panels 54, 56 can be adhered to respective side end flaps 42, 44, such that the adhesive panels form reinforced portions of the side end flaps. The blank 3 may be otherwise configured to have multiple top panels and/or multiple bottom panels without departing from the scope of this disclosure. Further, the carton 5 may be a wrap-around type carton, with the blank 3 including locking features that can include primary and secondary locking features as is known in the art. These locking features may also comprise a single locking system or a double locking system such as those disclosed in U.S. patent application Ser. Nos. 10/183,935 and 10/703,704, the entire disclosures of which are incorporated by reference herein.

In the illustrated embodiment, the first end 51 of the carton 5 is closed by respectively overlapping and adhering the side end flaps 22, 42 and the top and the bottom end flaps 12, 32. The second end of the carton 5 is closed by respectively overlapping and adhering the side end flaps 24, 44 and the top and the bottom end flaps 14, 34. Once the blank 3 is formed into the sleeve 181 and with the second end closed, the containers may be loaded in the carton 5 from the first end 51 and then the first end may be closed by overlapping and gluing the side end flaps 22, 42. Alternative loading and closing steps may be used without departing from the scope of this disclosure.

Figure 5:
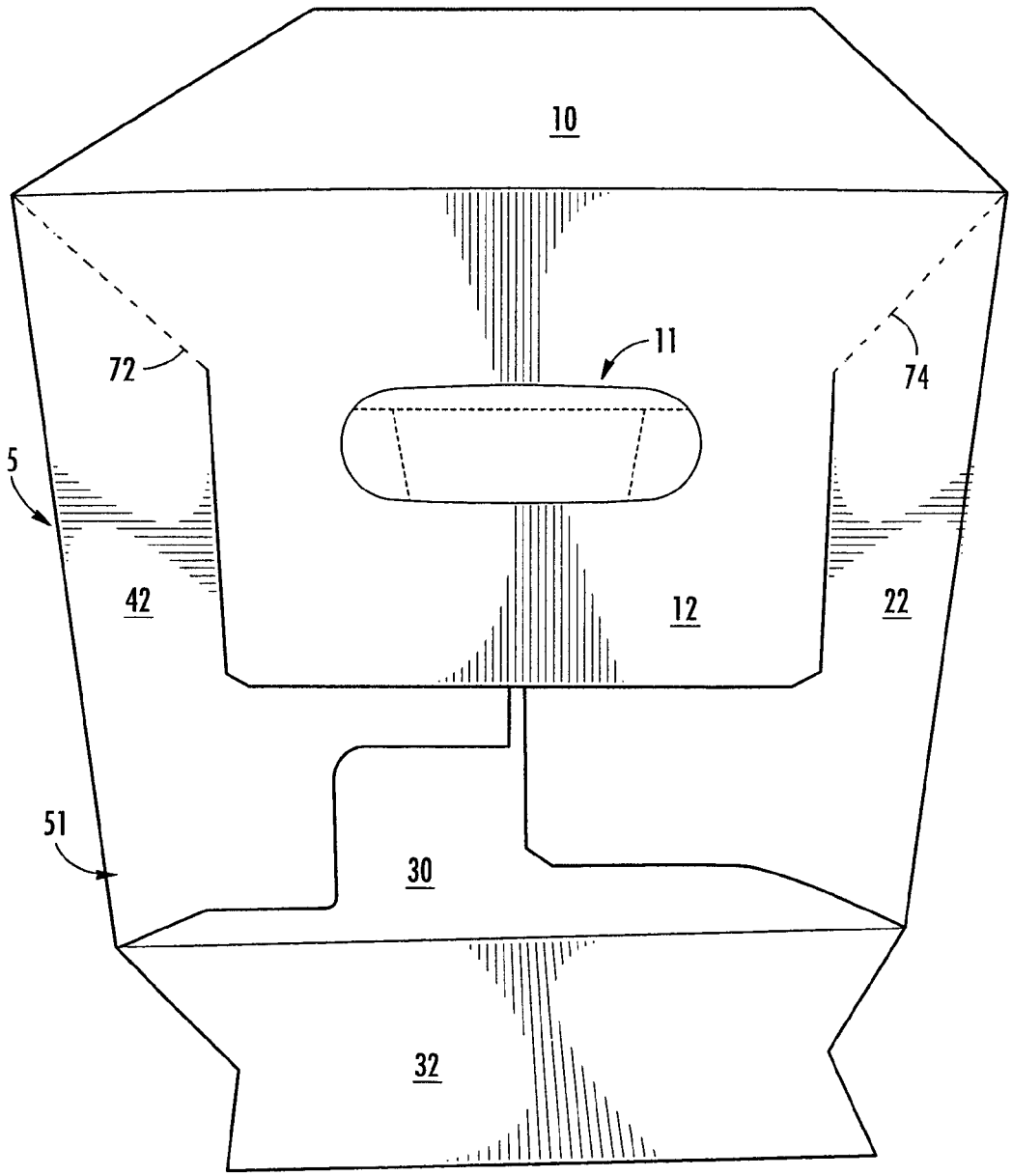
Figure 6:
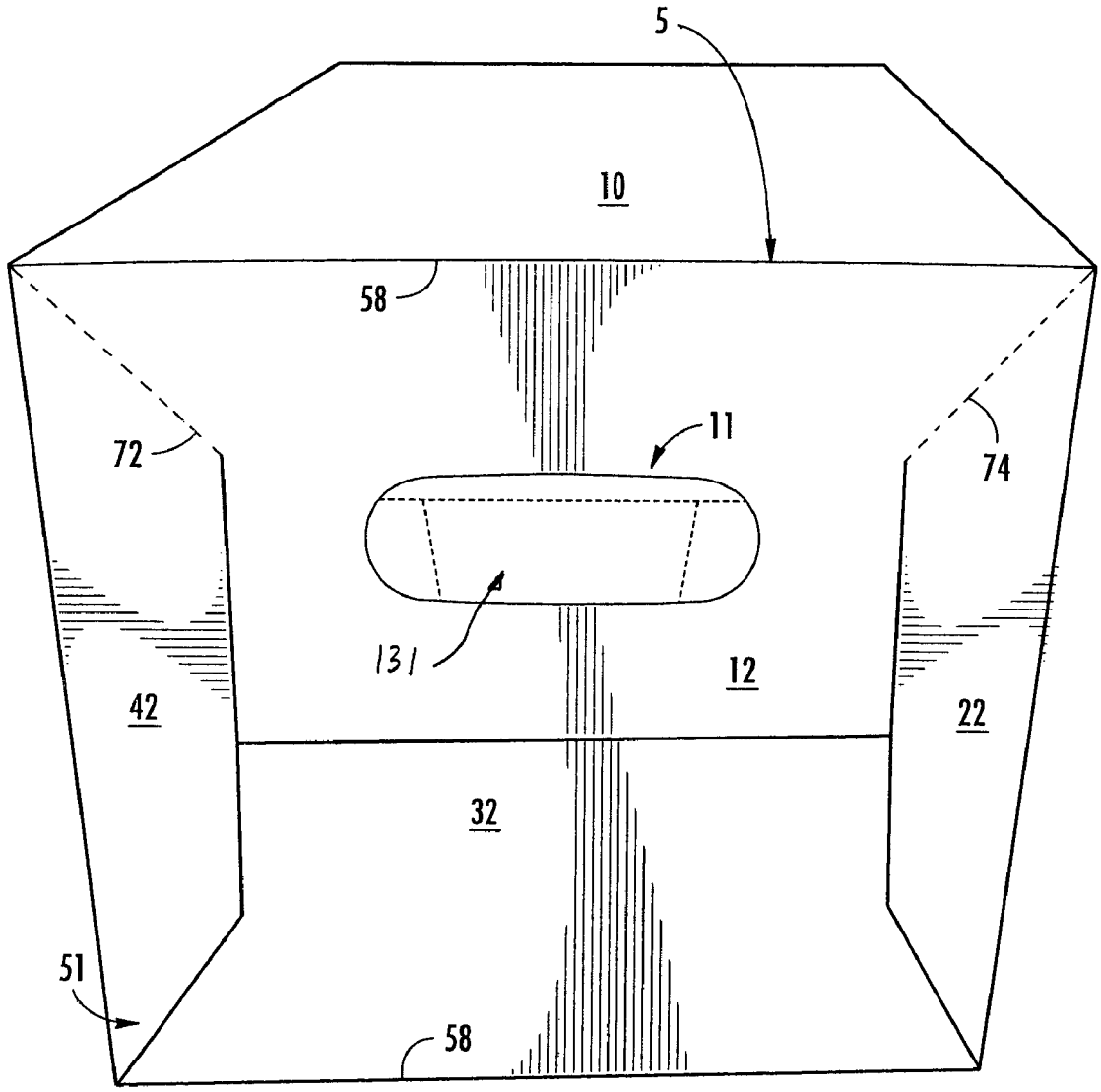
Figure 7:
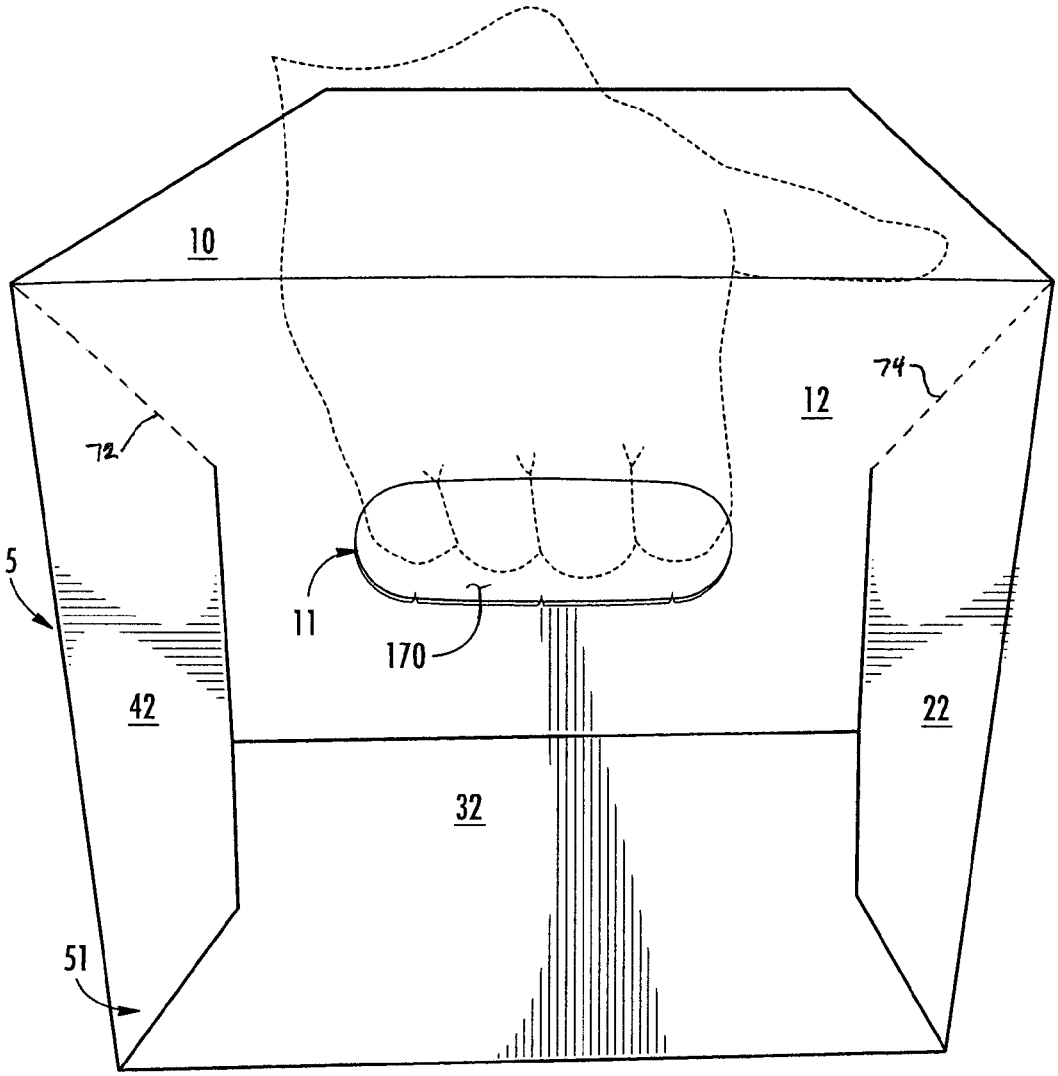

FIGS. 3-6 illustrate the closing of the first end 51 of the carton 5 according to one exemplary method. From the partially assembled position of FIG. 3, the first side flaps 22, 42 are folded inward causing the top end flap 12 to raise and the extension panels 62, 64 to fold inward at the oblique fold lines 72, 74 to partially close the first end 51 of the carton 5 (FIG. 4). The extension panels 62, 64 are in generally face-to-face contact with portions of the top end flap 12 which has been raised by the inward folding of the side and flaps 22, 42. The top end flap 12 is then folded downward at fold line 58 forcing the extension panels 62, 64 to be downwardly folded at fold lines 66, 68. In the downwardly folded position of FIG. 5, the handle flap 131 is aligned with the curved cutouts 162, 164 (FIG. 5). When lowered from the position of FIG. 4, the top end flap 12 contacts the extension panels 62, 64 of the first side panels 22, 42 to fold the extension panels 62, 64 downward along the respective lateral fold lines 66, 68 so that the extension panels 62, 64 overlap a respective upper portion of each of the main panels 26, 46 between the lateral fold lines 66, 68 and the cutouts 162, 164 (FIG. 5). The top panel 12 is then further folded downward and secured in the position shown in FIG. 5 so that the handle flap 131 is aligned with the handle cutouts 162, 164. With the top end flap 12 lowered, the bottom end flap 32 is raised (FIG. 6) to further close the end 51 of the carton 5. In one embodiment, the exterior surface of the downwardly folded extension panels 62, 64 will typically be in opposing face-to-face contact with a portion of the exterior surface of the side end flaps 22, 42. Specifically, the portion of the exterior surface of the side end flaps 22, 42 that is in face-to-face contact with the exterior surface of the downwardly folded extension panels comprises a respective upper portion of the main panels 26, 46 below the fold lines 66, 68 and above the cutouts 162, 164. In one embodiment, at the closed end 51 of the carton a portion of the interior surface of the top end flap 12 is in face-to-face contact with the interior surface of the extension panels 62, 64 and a portion of the interior surface of the top end flap is in face-to-face contact with the exterior surface of the main panels 26, 46 of the side end flaps 22. The downwardly folded extension panels 62, 64 may be secured to the main panels 26, 46 of the side end flaps 22, 42 by adhesive such as glue. Also, the extension panels 62, 64 may be respectively secured to one or both of the top end flap 12 and a respective one of the side end flaps 22, 42. Further, the bottom end flap 32 can be secured to one or more of the top end flap 12, and side end flaps 22, 42.

The side end flaps 24, 44, top end flap 14, and bottom end flap 34 at the second end 53 of the carton 5 can be positioned in a similar manner as described above to close the second end of the carton. Alternatively, the end flaps 24, 44, 14, 34 can be alternatively shaped, arranged, and/or positioned without departing from the scope of the disclosure.

The handle 11 may be used to grasp the carton 5 by pressing against the elongate handle flap 131 to create the handle opening 170 (FIG. 7) in the closed end 51 of the carton 5. The downwardly folded extension panels 62, 64 of the side end flaps 22, 42 provides an extra layer of material above the handle 11 to reinforce the carton 5 when the carton is lifted at the handle. In the area above the handle 11, the carton 5 has four layers of material (e.g., side end flaps 22, 42, extension panels 62, 64, top end flap 12, and the inwardly folded flap 131) above the handle opening 170 to increase the strength of the carton in the area of the handle. The second handle 13 is similar to the handle 11 and is for grasping at the second end (not shown) of the carton in a similar manner as the first handle. The handle 11 is shaped and positioned in the carton so that multiple fingers of a user may be placed through the handle opening 170 in the overlapped top end panel 12 and first side panels 22, 42 and the thumb of a user may be placed on the top panel 10 for grasping and lifting the carton 5 The extension panels 62, 64 increases the strength and rigidity of the carton 5 in the area above the handle 11 to prevent the carton from tearing or otherwise failing when lifted. As illustrated, the extension panels 62, 64, side end flaps 22, 42, and top end flap 12 together form a reinforced region above the handle 11 that has a thickness of three-ply's of material.

The blank 3 according to the present disclosure can be, for example, formed from coated paperboard and similar materials. For example, the interior and/or exterior sides of the blank 3 can be coated with a clay coating. The clay coating may then be printed over with product, advertising, price coding, and other information or images. The blank 3 may then be coated with a varnish to protect any information printed on the blank. The blank 3 may also be coated with, for example, a moisture barrier layer, on either or both sides of the blank. In accordance with the above-described embodiments, the blank 3 may be constructed of paperboard of a caliper such that it is heavier and more rigid than ordinary paper. The blank 3 can also be constructed of other materials, such as cardboard, hard paper, or any other material having properties suitable for enabling the carton 5 to function at least generally as described herein. The blank 3 can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a plurality of articles, the carton comprising:

a plurality of panels that extends at least partially around an interior of the carton, the plurality of panels comprise a top panel, a bottom panel, a first side panel, and a second side panel;

at least two end flaps respectively foldably attached to respective panels of the plurality of panels, wherein the end flaps are overlapped with respect to one another and thereby at least partially form a closed end of the carton, the at least two end flaps comprising at least one side end flap and at least one top end flap; and a handle in the closed end of the carton for grasping and carrying the carton, the at least one side end flap of the at least two end flaps comprises a main panel closing the closed end of the carton and an extension panel foldably connected to the main panel and the at least one top end flap, the extension panel being positioned above the handle to reinforce the carton.

2. The carton of claim 1, wherein the extension panel is disposed between the main panel and the top end flap, the top end flap at least partially overlaps the main panel.

3. The carton of claim 2 wherein the extension panel is in face-to-face contact with an exterior surface of the main panel.

4. The carton of claim 2 wherein the extension panel is in face-to-face contact with an interior surface of the top end flap.

5. The carton of claim 1 wherein the at least one side end flap comprises a first side end flap foldably connected to the first side panel and a second side end flap foldably connected to the second side panel.

6. The carton of claim 5 wherein the handle comprises a handle cutout in each of the first side end flap and the second side end flap.

7. The carton of claim 6 wherein the handle comprises a handle flap foldably attached to the top end flap for forming a handle opening aligned with the handle cutouts.

8. The carton of claim 1 wherein the extension panel is downwardly folded when the top end flap is closed.

9. The carton of claim 1 wherein the extension panel is foldably connected to the main panel at a first fold line in the at least one side panel and the extension panel is foldably connected to the at least one top end flap at a second fold line that is oblique relative to the first fold line.

10. The carton of claim 1 wherein:

the closed end is a first closed end;

the end flaps are first end flaps that are overlapped with respect to one another to form the first closed end; and the carton further includes at least two second end flaps respectively foldably attached to respective panels of the plurality of panels, wherein the second end flaps are overlapped with respect to one another to form a second closed end of the carton at an opposite end from the first closed end.

11. The carton of claim 1 in combination with a plurality of articles, the plurality of articles comprising bottles that are arranged in an upright position in the carton.

12. A blank for forming a carton comprising:

a plurality of panels comprising a top panel, a bottom panel, a first side panel, and a second side panel;

at least two end flaps respectively foldably attached to respective panels of the plurality of panels at a first marginal end of the blank, the at least two end flaps comprising at least one side end flap and at least one top end flap; and features in the at least two end flaps, wherein the features are for cooperating to at least partially define a handle in a carton erected from the blank, the at least one side end flap of the at least two end flaps comprises a main panel for closing an end of the carton erected from the blank and an extension panel foldably attached to the main panel and the at least one top end flap, the extension panel is for being positioned above the handle when the blank is erected into the carton.

13. The blank of claim 12 wherein the at least one side end flap comprises a first side end flap foldably attached to the first side panel and a second side end flap foldably attached to the second side panel.

14. The blank of claim 13 wherein the handle comprises a handle cutout in each of the first side end flap and the second side end flap.

15. The blank of claim 14 wherein the handle comprises a handle flap foldably attached to the top end flap for forming a handle opening aligned with the handle cutouts.

16. The blank of claim 15 wherein each extension panel is for being downwardly folded by engagement with the top end flap when the carton erected from the blank is closed.

17. The blank of claim 12 wherein the extension panel is foldably connected to the main panel at a first fold line in the at least one side panel and the extension panel is foldably connected to the at least one top end flap at a second fold line that is oblique relative to the first fold line.

18. The blank of claim 12 wherein:

the end flaps are first end flaps that are overlapped with respect to one another to form a first closed end of the carton erected from the blank; and the blank further includes at least two second end flaps respectively foldably attached to respective panels of the plurality of panels at a second marginal end of the blank, the at least two second end flaps are overlapped with respect to one another to form a second closed end of the carton erected from the blank.

19. A method of assembling a carton comprising:

obtaining a carton comprising a plurality of panels, comprising a top panel, a bottom panel, a first side panel, and a second side panel, at least one side end flap foldably attached to at least one of the first and second side panels at a first end of the carton, at least one top end flap foldably attached to the top panel at the first end, the at least one side end flap comprising a main panel for at least partially forming a closed end of the carton and an extension panel foldably attached to the main panel and the top end flap;

folding the at least one side end flap to at least partially close the first end of the carton;

folding the top end flap downward to contact the extension panel and fold the extension panel downward to overlap the main panel; and securing the top panel to at least partially close the carton.

20. The method of claim 19 further comprising securing the extension panel to the main panel.

21. The method of claim 19 wherein the at least one side end flap comprises two side end flaps.

22. The method of claim 21 wherein the handle comprises a handle flap foldably attached to the top panel and handle cutouts in the two side end flaps, and the method further comprises folding the handle flap into the handle cutouts in the at least two side end flaps to form a handle opening of the carton.

23. The method of claim 19 wherein the carton further comprises a plurality of end flaps at the second end of the carton and the method further comprises overlapping the plurality of end flaps at the second end to close the second end of the carton.

* * * * *

UNITED STATES PATENT AND TRADEMARK OFFICE

CERTIFICATE OF CORRECTION

PATENT NO. : 7,984,843 B2
APPLICATION NO. : 12/561379
DATED : July 26, 2011
INVENTOR(S) : Cooper et al.

It is certified that error appears in the above-identified patent and that said Letters Patent is hereby corrected as shown below:

Title page, section (63), after --Continuation-in-part of application No. 11/532,293, filed on Sep. 15, 2006-- delete ", application No. 12/561,379"

Signed and Sealed this
Sixth Day of December, 2011

David J. Kappos

David J. Kappos
*Director of the United States Patent and Trademark Office*